US009957758B2

(12) United States Patent
Boulet

(10) Patent No.: US 9,957,758 B2
(45) Date of Patent: May 1, 2018

(54) DRILL STEM ELEMENT AND CORRESPONDING DRILL PIPE

(71) Applicant: VALLOUREC DRILLING PRODUCTS FRANCE, Cosne Cours sur Loire (FR)

(72) Inventor: Jean Boulet, Paris (FR)

(73) Assignee: VALLOUREC DRILLING PRODUCTS FRANCE, Cosne Cours sur Loire (FR)

( * ) Notice: Subject to any disclaimer, the term of this patent is extended or adjusted under 35 U.S.C. 154(b) by 832 days.

(21) Appl. No.: 14/346,220

(22) PCT Filed: Oct. 1, 2012

(86) PCT No.: PCT/EP2012/004115
§ 371 (c)(1),
(2) Date: Mar. 20, 2014

(87) PCT Pub. No.: WO2013/050131
PCT Pub. Date: Apr. 11, 2013

(65) Prior Publication Data

US 2014/0224546 A1 Aug. 14, 2014

(30) Foreign Application Priority Data

Oct. 4, 2011 (FR) ..... 11 03009

(51) Int. Cl.
*E21B 17/10* (2006.01)
*E21B 17/02* (2006.01)

(52) U.S. Cl.
CPC ..... *E21B 17/02* (2013.01); *E21B 17/1064* (2013.01); *E21B 17/1085* (2013.01)

(58) Field of Classification Search
CPC ... E21B 17/02; E21B 17/1064; E21B 17/1085
See application file for complete search history.

(56) References Cited

U.S. PATENT DOCUMENTS 2,262,211 A * 11/1941 Stone ..... E21B 17/0423 175/325.5
4,251,840 A * 2/1981 Maruyama ..... F16C 17/08 360/271.3

(Continued)

FOREIGN PATENT DOCUMENTS

CN 2811542 Y 7/2005
CN 201363103 Y 1/2009

(Continued)

OTHER PUBLICATIONS

U.S. Appl. No. 13/060,965, filed Feb. 25, 2011, 2011-0155470, Boulet.

(Continued)

*Primary Examiner* — David J Bagnell
*Assistant Examiner* — Ronald R Runyan
(74) *Attorney, Agent, or Firm* — Oblon, McClelland, Maier & Neustadt, L.L.P.

(57) ABSTRACT

A drill stem element for drilling a well with flow of a drilling fluid around the element and in a direction extending from a drilling well bottom towards the surface, including a member and a coupling mounted for rotation about the member. The coupling includes at least two abutment zones on a wall of the well during drilling, each abutment zone externally includes at least one abutment portion having an outer diameter greater than a diameter of other portions of the element, each abutment zone having a convex rounded shape generated by revolution, each abutment zone being axially remote from at least one other abutment zone. The coupling further includes an intermediate zone between the two abutment zones, an opening being provided between the coupling and the member for the flow of drilling fluid between the coupling and the member forming a fluid bearing.

20 Claims, 4 Drawing Sheets

(56) References Cited

U.S. PATENT DOCUMENTS

| | | | | |
|---|---|---|---|---|
| 5,018,771 | A * | 5/1991 | Watts | E21B 17/042 285/333 |
| 6,032,748 | A | 3/2000 | Debray et al. | |
| 6,056,073 | A | 5/2000 | Boulet | |
| 6,655,477 | B2 | 12/2003 | Appleton et al. | |
| 6,739,415 | B2 | 5/2004 | Mitchell et al. | |
| 8,434,570 | B2 | 5/2013 | Boulet | |
| 2002/0129976 | A1* | 9/2002 | Rastegar | E21B 17/1064 175/325.3 |
| 2010/0069122 | A1* | 3/2010 | Ito | H04B 7/0684 455/562.1 |
| 2011/0155470 | A1 | 6/2011 | Boulet | |

FOREIGN PATENT DOCUMENTS

| | | | |
|---|---|---|---|
| FR | 2 760 783 | 3/1997 | |
| FR | 2 851 608 | 8/2004 | |
| FR | 2 927 936 | 2/2008 | |
| FR | 2 927 937 | 11/2008 | |
| FR | 2 953 249 | 6/2011 | |
| WO | WO 2009115687 A1 * | 9/2009 | E21B 7/04 |
| WO | WO 2010022755 A1 * | 3/2010 | E21B 17/10 |
| WO | 2011/091500 | 8/2011 | |

OTHER PUBLICATIONS

International Search Report dated Nov. 9, 2012, in PCT/EP2012/004115, filed Oct. 1, 2012.

* cited by examiner

DRILL STEM ELEMENT AND CORRESPONDING DRILL PIPE

The invention relates to the field of exploration and exploitation of petroleum or gas deposits, in which there are used rotary drill stems which are constituted by pipes and optionally other tubular components which are assembled end to end in accordance with the requirements of the drilling operation. The invention more particularly relates to connection components which are provided with a coupling which can rotate freely in order to facilitate the rotation of the whole of the drill stem in the drill hole. Those connections allow a reduction in the friction resistance of the drill stem when it is used in a drill hole.

The invention more particularly relates to a profiled component for a rotary piece of drilling equipment, such as a pipe, which is arranged in a rotary string of pipes.

Such strings of pipes associated with other components of the drill stem (drill collar, stabiliser, etc.) may particularly allow deviating drilling operations to be carried out, that is to say, drilling operations in which it is possible to vary the inclination relative to the vertical or the azimuth direction during drilling. Nowadays, deviating drilling operations may reach depths in the order of from 2 to 8 kilometers and horizontal distances in the order of from 2 to 15 kilometers.

In the case of deviating drilling operations comprising practically horizontal portions, the friction torques owing to the rotation of the pipe strings in the well may reach very high values during drilling. The friction torques may challenge the equipment used or the objectives of the drilling. Furthermore, the raising of drillings produced by the drilling operation is very often difficult taking into consideration the sedimentation of the debris produced in the drill hole, in particular in the portion that is greatly inclined relative to the vertical of the drill hole. This results in poor cleaning of the well and a simultaneous increase of the friction coefficients of the pipes of the pipe string inside the drill hole and the contact surfaces between the pipes and the walls of the well.

Document U.S. Pat. No. 6,032,748 describes a stabiliser having two half-shells and blades of elastomer material for mounting on an ordinary portion of a drill stem. Document U.S. Pat. No. 6,655,477 describes a friction reduction unit having roller bearings or a fluid bearing for a drill pipe. Document U.S. Pat. No. 6,739,415 describes a coupling for protecting a drill pipe comprising low-friction bearings in contact with a collar of the drill pipe and longitudinal grooves in an internal wall.

Document FR 2760783 sets out a profile for a drill pipe having a coupling which comes into contact with the wall of the drill hole and which may remain stationary in terms of rotation whilst being able to slide relative to the wall and grooved portions which allow the flow of the drilling fluid to be activated.

Work by the Applicant intended to obtain robust drill stems has resulted in the documents FR 2927936 and FR 2927937. Those types of device are satisfactory in terms of activation of the flow of a drilling fluid in the drill hole around the drilling equipment. In order to be able to achieve increased drilling depths and horizontal offsets, the Applicant has sought to reduce the friction occurring during the rotation and translation of a drill pipe in the drill hole.

The invention is intended to improve the situation.

A drill stem element for drilling a well with flow of a drilling fluid around the element and in a direction extending from a drill hole bottom towards the surface comprises a member and a coupling which is mounted for rotation about the member. The coupling comprises at least two abutment zones for abutment against the wall of the well during drilling. Each abutment zone is externally provided with at least one abutment portion having an outer diameter greater than the diameter of the other portions of the element. Each abutment zone has a convex rounded shape generated by revolution, each abutment zone being axially remote from at least one other abutment zone. The coupling comprises an intermediate zone which is provided between the two abutment zones. An opening is provided between the coupling and the member for the flow of drilling fluid between the coupling and the member forming a fluid bearing. The coupling is free to rotate in relation to the member. The opening corresponds at least to the annular play which exists between the coupling and the member in order to allow the coupling to rotate about the member.

In one embodiment, the opening may be in fluid communication with a plurality of holes which are circumferentially distributed and which are arranged in the coupling between an external surface and an internal surface. The supply of the fluid bearing is thereby facilitated.

In one embodiment, at least one hole may open in a portion of the external surface having a diameter smaller than the diameter of the abutment zones, preferably in the region of the intermediate zone. In such a configuration, the hole opens in a zone having lower pressure in relation to the pressure of the mud at other levels along the coupling. That zone having lower pressure promotes the flow of the mud which has been introduced between the member and the coupling in the direction of the hole and, more generally, in accordance with a path parallel with that pressure gradient.

In one embodiment, the intermediate zone of the coupling may have a diameter smaller than the diameter of the abutment zones, preferably smaller by from 5% to 10% of the diameter of the abutment zones. In particular the intermediate zone may form the zone having the minimum outer diameter of the coupling.

In one embodiment, the coupling may have an end having a diameter smaller than the diameter of the abutment zones and, in particular, the two axial ends thereof having a diameter smaller than the diameter of the abutment zones.

In one embodiment, the coupling may comprise at least one drilling fluid distribution channel which is provided on an internal surface of the coupling. Occurrences of contact metal on metal are reduced. The drilling fluid lubricates the rotation of the coupling about the member.

In one embodiment, the channel may comprise at least one helical portion, preferably two helical portions, one orientated to the left and the other orientated to the right. The rotation of the coupling facilitates the distribution of fluid.

In one embodiment, the coupling may comprise at least one annular channel, preferably at least two annular channels. An annular channel may be provided near the fluid inlet, for example, at a distance in the order of from 10 to 40 mm from an end surface. An annular channel may be provided at the centre of the coupling, for example, in the region of the intermediate zone.

In one embodiment, the member may comprise at least one zone in contact with an internal surface of the coupling, the hardness of the zone being greater than the hardness of the internal surface of the coupling. The wear of the member, the largest piece of the component, is reduced.

In one embodiment, the abutment portion may have a hardness greater than the hardness of the remainder of the external surface of the coupling.

For example, the abutment portion may have a cylindrical geometry. The abutment zone comprises, at one side and the other of the abutment portion, convex portions which surround the abutment portion along the axis of the coupling. Preferably, the convex portions have a radius of curvature such that the convex portions form a tangent to the abutment portion. In such a configuration, the intermediate zone may be formed by a concave portion which connects the adjacent convex portions of two consecutive abutment zones of the coupling.

In one embodiment, the element may comprise a wear ring which is mounted between a front surface of the coupling and a shoulder of the member. The wear ring is readily replaceable.

In one embodiment, the element may comprise a wear ring which is mounted between a front surface of the coupling and a front surface of a retention member.

In one embodiment, the element may comprise a retention member of the coupling. The retention member comprises a plurality of segments which form an abutment ring and which are provided at least partially in an annular groove provided in the member and having a surface for maintaining the axial position of the sleeve, an annular locking ring comprising an internal surface in contact with and radially locking the segments which form an abutment ring, and a lock which axially locks the segments which form an abutment ring in relation to the member. The risk of inadvertent disassembly of the coupling is low.

In one embodiment, the element may comprise at least one activation zone which comprises a plurality of grooves which are generally of helical shape around the axis of the element.

In one embodiment, the element may comprise an additional coupling which is provided with at least one activation zone.

In one embodiment, the activation zone may be provided in an annular locking ring which comprises an internal surface in contact with and radially locking segments which form an abutment ring.

A drill pipe may comprise at least one element as described above, and two threaded ends which are provided at one side and the other of the element.

The term "drill stem element" is intended to refer not only to the components of the drill stem (drill pipe, etc.) but also portions which constitute said components such as, for example, the threaded connectors ("tool-joints") which may be fitted to the ends of the pipes by any means such as, for example, by welding, and which allow the pipes to be assembled together by make up.

The terms upstream and downstream relate in this instance to the direction of flow of the drilling fluid in the annular space around the element.

In modern wells having a profile with a three-dimensional trajectory, the string of drill pipes is subjected to complex static and dynamic stress systems. An element according to the invention allows use of the strings of drill pipes under improved safety conditions because the use of that element allows the whole of the drill stem to be safeguarded from rupture conditions.

The Applicant has constructed a tool for reducing mainly the friction during rotation but also axial friction, at a reasonable cost and having advantageous properties. The friction reduction tool may be provided at predetermined locations of the string of pipes between two pipes. The Applicant has obtained significant results involving a reduction in the friction during rotation whilst optimising the friction during translation, whether this be in the ascending or descending direction. The friction stresses in a drill stem element depend on a number of factors such as the friction coefficients, the contact pressure, the profile of the contact pressure, the distribution of the transverse loads, the dynamic behaviour of the drill stem and the real position of the friction reduction tool in relation to the walls of the well. An element comprising the friction reduction tool allows better positioning of the pipe in the well and may also improve the hydrodynamics of the drilling by reducing the resistance to displacement of the drill stem through the drilling fluid.

The Applicant has established a reduction in the torsion stresses, a reduction in the axial loads, an increase in the critical buckling load, an improvement in the sliding and guiding properties, a better transfer of the gravitational force, better dynamic distribution of the contact locations against the wall of the well during the rotation of the drill stem, a satisfactory damping of the vibrations, particularly owing to reduction of the amplitude of turbulent vibrations and a reduction in the wear of the casing. The drill stem element is found to be particularly reliable, vibration-resistant and insensitive to blockages connected with the presence of particles, relative pressures or great loads.

The present invention will be better appreciated from a reading of the detailed description of a number of embodiments taken by way of non-limiting example and illustrated by the appended drawings, in which.

Figure 1:
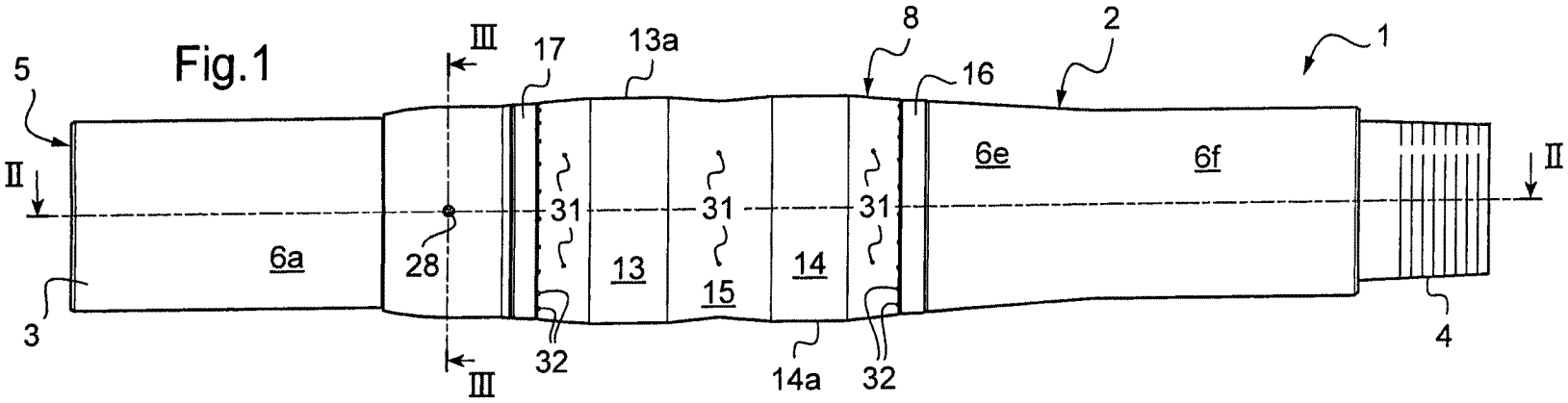
FIG. 1 is a side elevation view of a drill stem component.

As can be seen in the Figures, the profiled pipe or drill stem component 1 generally has a shape generated by revolution about an axis which substantially constitutes the axis of the drilling operation when the component 1 of a drill stem is in the operating position inside a drill hole which is constructed by a tool such as a bit provided at the end of the drill stem. The axis of the component is the axis of rotation of the string of pipes in a normal operating condition and as a first approximation. The component 1 is of tubular shape, a channel 1*a* of substantially cylindrical shape generated by revolution being provided in the central profiled portion of the component 1.

The components of the drill stem, in particular the elements of the component 1 illustrated in the Figures, are constructed in tubular form and are intended to be connected to simple tubular pipe strings so that their central channels 1*a* are located in continuation of each other and constitute a continuous central space for the flow of a drilling fluid in a downward direction between the surface from which the drilling is carried out as far as the bottom of the drill hole where the drilling tool is working. For example, such a component 1 is provided every 30 to 60 meters, for example, regularly after 3 or 6 similar standard pipes which are assembled end to end with respect to each other. The fluid at the end of the drill stem subsequently ascends into an annular space which is delimited between the wall of the drill hole and the external surface of the drill stem. A drill stem may comprise pipes, heavyweight drill pipes, drill collars, stabilisers or connections. The pipes are assembled end to end by make up to form a string of pipes which constitutes a significant portion of the length of the drill stem.

The drilling fluid, as it rises on the outer side of the drill pipe, carries debris of geological formations, through which the drilling tool has passed, towards the surface from which the drilling is being carried out. The string of drill pipes is configured so as to facilitate the ascending flow of the drilling fluid in the annular space between the drill stem and the wall of the well. It is desirable to carry the drilling debris in an effective manner and to produce cleaning of the wall of the drilling hole and the abutment surfaces of the string of pipes in order to facilitate the progress of the string of drill pipes inside the well.

The characteristics of a drill pipe and more generally of a drill stem element contribute to the fundamental properties of quality, effectiveness and safety of the general drilling process, whether that be during the actual excavation phases or during the handling phases between the bottom and the surface. Developments in the search for hydrocarbons require that profiles having more and more complex trajectories be brought about under geological conditions which are more and more extreme.

The drill stem element comprises a coupling which can rotate freely in relation to a member. The coupling has an inner profile and an outer profile which are optimised in order to reduce the axial and rotational frictional loads whilst promoting the guiding of the element, the sliding in relation to the well and the distribution of the dynamic loads during rotation. The outer profile of the coupling is neutral in relation to the fluid lines in the annular passage in order to prevent turbulence. The coupling generates a distribution of pressures which promotes the operations of the fluid bearing between the coupling and the member and the flow to the outer side of the coupling. The outer profile of the coupling generates a reaction torque under the effect of the lateral loads at the different contact locations of the coupling, thereby producing a tendency to move the element back in a stable direction parallel with the axis of the drill hole owing to the restoring torque effect.

The drill stem component 1 comprises in this instance a drill stem element which is supplemented by two profiled end portions 3 and 4, the element comprising a central portion 2 or element. The central portion 2 and the end portions 3 and 4 are integral. The drill stem component as illustrated in the Figures is a connection of small total length in the order of from 1 to 2 meters and is provided to be positioned between two drill pipes. The profiled end portions 3 and 4 and the central portion 2 may be produced from steel having high mechanical strength. By way of an alternative, a very long tubular portion, for example, greater than 10 meters, could be provided between the central portion and one of the profiled end portions which confer on the component the nature of a drill pipe. The female end portion 3 comprises a female connection bore portion which is provided with a female thread 3*b* for connection to a male thread of another component. The female thread 3*b* may be frustoconical, for example, in accordance with the specification API7 or in accordance with one of the patents of the Applicant, for example, U.S. Pat. No. 7,210,710 or U.S. Pat. No. 6,513,840, to which the reader is invited to make reference.

Correspondingly, the male end portion 4 comprises a male connection portion which comprises a male thread 4*b* for connection to a female thread of another component.

The end portions 3, 4 and the central portion 2 form a member 5 of the component 1. The component 1 is tubular with a channel 1*a* that is a cylindrical bore extending through the component 1 in accordance with the axis thereof. The central portion 2 has an external surface 6 which comprises, in the direction from the female end portion 3 towards the male end portion 4, a first cylindrical portion 6*a* which is generated by revolution and which forms an external surface of the female portion, a groove 6*b* of substantially rectangular shape when viewed as an axial section, a second cylindrical portion 6*c* which is generated by revolution and, in this instance, has the same diameter as the first cylindrical portion which is generated by revolution, a shoulder 6*d* extending radially towards the outer side, a surface 6*e* having a monotonous decreasing diameter, for example, frustoconical, with a minimum diameter equal to the diameter of the external surface of the male end portion and a third cylindrical portion 6*f* which is generated by revolution and, in this instance, has the same diameter as the first cylindrical portion 6*a* which is generated by revolution.

Figure 2:
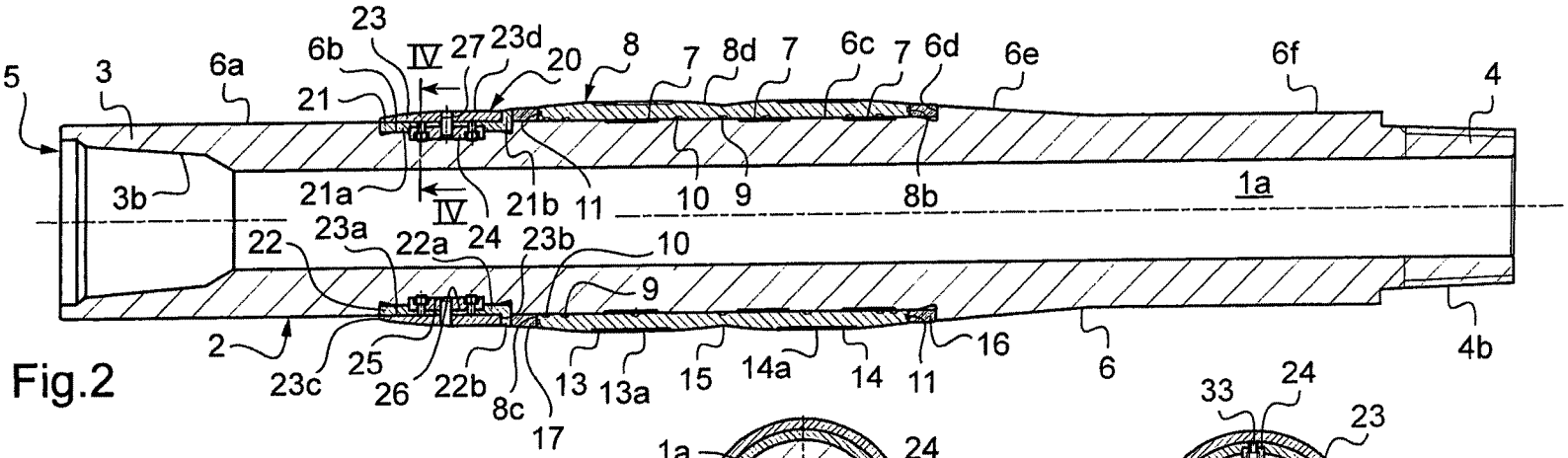
FIG. 2 is an axially sectioned view of a component of FIG. 1.

The groove 6*b* may have an axial length in the order of from 80 to 250 mm. The groove 6*b* comprises a bottom which forms a cylindrical surface generated by revolution. The groove 6*b* comprises substantially radial edges. The second cylindrical portion 6*c* may have an axial length in the order of from 300 to 600 mm. The surface 6*e* having a decreasing diameter may have an axial length in the order of from 120 to 300 mm. The central portion 2 comprises, on the second cylindrical portion 6*c*, zones 7 which are hardened by means of thermal and/or chemical processing, for example, by nitriding or carburation, allowing a reduction in the wear during operation and an increase in the service-life of the component. In FIGS. 1 and 2, three hardened annular zones 7 have been provided. The hardened annular zones 7 are provided with spacing from the groove 6*b* and the shoulder 6*d*.

The component 1 also comprises a coupling 8 which is mounted around the central portion 2 in a removable manner. The coupling 8 is of generally annular shape. The coupling 8 may be mounted by means of translation along the axis of the component by sliding the coupling 8 around the female end portion 3 and the first cylindrical portion 6*a* of the central portion 2.

Figure 5:
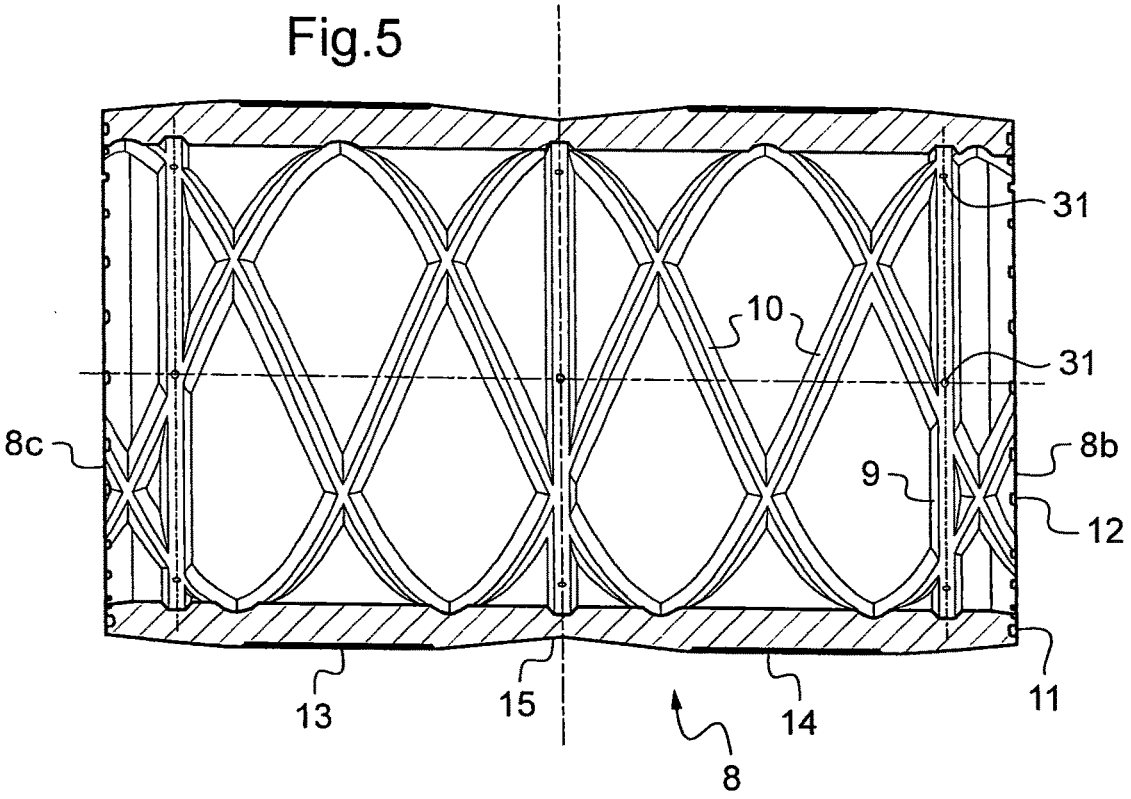
FIG. 5 is an axially sectioned view of a coupling which is part of a drill stem component.
Figure 6:
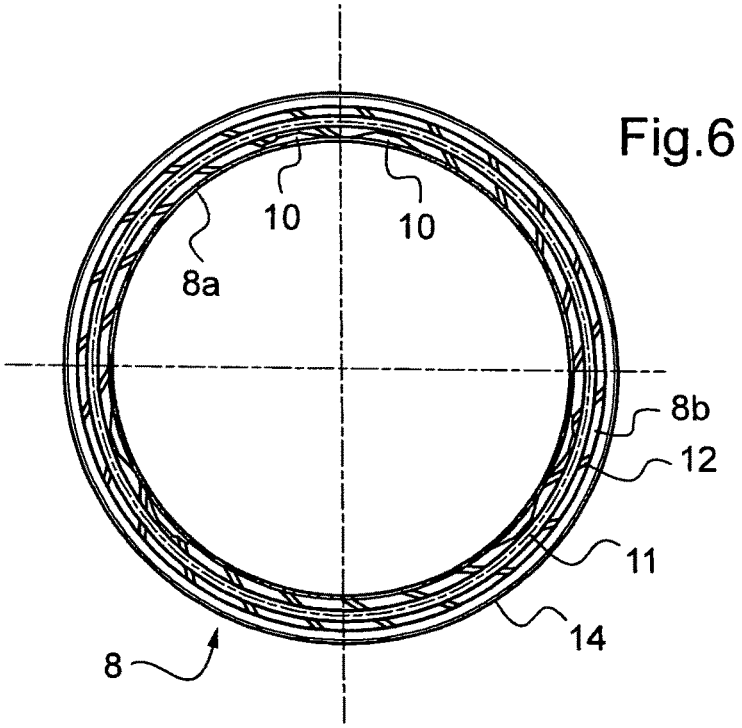
FIG. 6 is a front elevation view of the coupling of FIG. 5.

The coupling 8 comprises a bore 8*a* of generally cylindrical shape which is generated by revolution, with channels 9, 10 which are visible in FIG. 2 and which are illustrated in greater detail in FIG. 5. The channels 9, 10 are in the form of grooves which are provided in the thickness of the coupling 8 from the bore 8*a* thereof. The coupling 8 also comprises two substantially radial end surfaces 8*b* and 8*c* which are also provided with channels 11, 12 (see FIG. 6) in the form of grooves. The coupling 8 comprises an external surface 8*d* having a shape generated by revolution. The external surface 8*d* is slightly curved. The external surface 8*d* has a maximum diameter with spacing from the end surfaces 8*b* and 8*c*.

The coupling 8 comprises two hardened abutment zones 13, 14, at least one of which has the maximum diameter mentioned. The hardened abutment zones 13, 14 form part of the external surface 8*d*. The hardened abutment zones 13, 14 may comprise a deposit of hard materials different from the metal forming the majority of the coupling 8, the metal generally being steel or titanium. The hardened abutment zones 13, 14 may be obtained by a chemical and/or thermal processing operation, for example, nitriding or carburation, of the metal forming the majority of the coupling 8. The hardened abutment zones 13, 14 each comprise an abutment portion 13*a*, 14*a* which has an outer diameter greater than the other portions of the component. The outer diameter of the abutment portions 13*a*, 14*a* is greater than the maximum outer diameter of the member 5. The outer diameter of the abutment portions 13*a*. 14*a* is greater than the maximum outer diameter of the wear rings described below. The outer diameter of the abutment portions 13*a*, 14*a* is greater than the outer diameter of non-hardened zones of the coupling 8.

In the embodiment illustrated in FIGS. 1 and 2, the coupling 8 comprises two hardened abutment zones 13, 14 which form abutment zones for the component and which have the maximum diameter. The maximum diameter of the coupling 8 is also the maximum diameter of the component. The hardened abutment zones 13, 14 are in this instance separated by an intermediate zone 15 having a diameter smaller than the maximum diameter.

The profile of the external surface 8*d* may be obtained by two circular arcs having a great radius, for example, of between 200 and 800 mm. The diameters are substantially equal. The circular arcs extend as far as the ready fillets linked to the end surfaces. The two circular arcs form two projections, at the top of which the hardened abutment zones 13, 14 are formed. The two circular arcs are connected to each other by a concave connection which has a radius smaller than the radii of the circular arcs. The concave connection has a radius of, for example, between 30 and 100 mm. The concave connection forms the intermediate circular zone 15.

Figure 7:
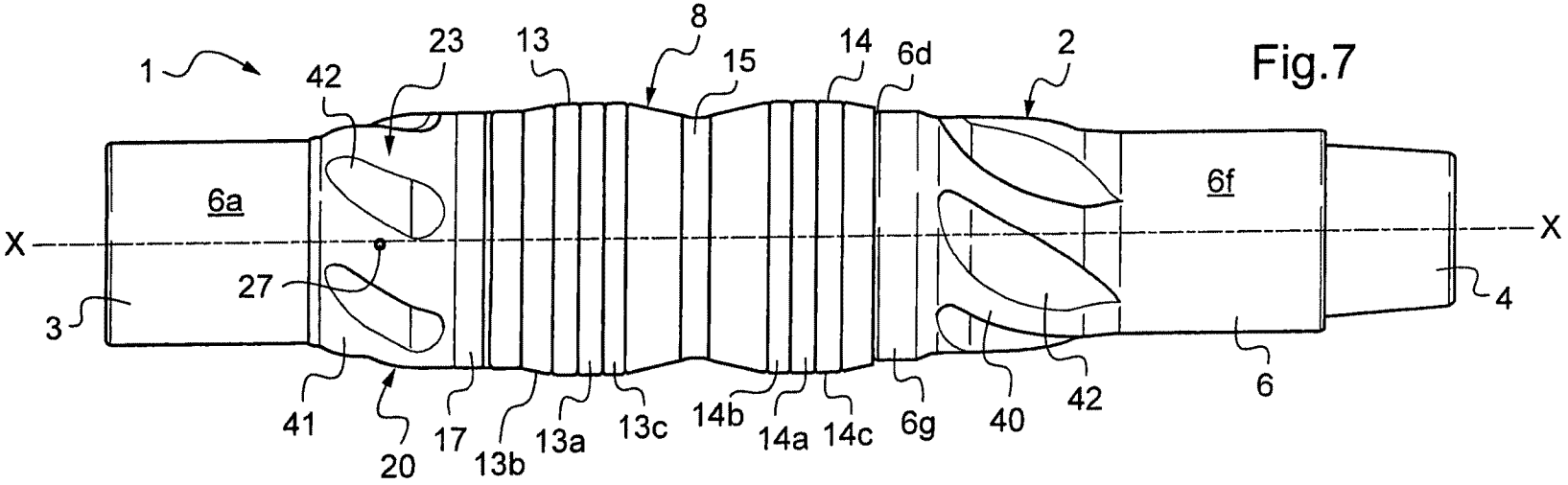
FIG. 7 is a side elevation view of a drill stem component according to another embodiment.
Figure 10:
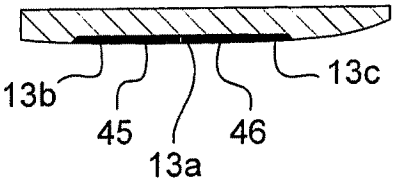
FIG. 10 is a detailed view of an abutment zone of a coupling which is part of a drill stem component.

In the embodiment of FIGS. 7 and 10, the abutment portions 13*a* and 14*a* both have a cylindrical shape generated by revolution. The hardened abutment zone 13 comprises, in addition to the abutment portion 13*a*, two convex portions 13*b* and 13*c* which are arranged axially at one side and the other of the abutment portion 13*a*. The hardened abutment zone 14 comprises, in addition to the abutment portion 14*a*, two convex portions 14*b* and 14*c* which are arranged axially at one side and the other of the abutment portion, respectively. For example, the convex portions 13*b*, 13*c*, 14*b* and 14*c* have a radius of curvature of between 200 and 800 mm, when viewed in section as illustrated. The convex portions are tangential to the abutment portion located between the convex portions. The convex portions and the abutment portion are connected so as to form tangency circles 45 and 46 which are visible in the form of sectioned tangency locations. A hydrodynamic profiling of the coupling is thereby achieved. A pressure gradient is produced at the outer side of the coupling which brings about the formation of a gradient inside the coupling and thereby promotes the microcirculation of the drilling fluids and prevents the accumulation of debris between the coupling 8 and the member. Therefore, the rotation of the coupling in relation to the member is preserved during drilling.

Also in this embodiment, the adjacent convex portions 13*c* and 14*b* which form part of two consecutive abutment zones of the coupling surround the intermediate zone 15 forming a connection. The intermediate zone 15 forms a concave connection having a radius smaller than the radii of the convex portions. The concave connection has a radius of, for example, between 30 and 100 mm.

The component 1 further comprises a first wear ring 16 which is arranged between one of the end surfaces 8*b* and the shoulder 6*d* of the external surface of the central portion 2. At the side of the shoulder 6*d*, the wear ring 16 has a radial dimension substantially equal to the radial dimension of the shoulder 6*d*. At the side of the end surface 8*b*, the wear ring 16 has a radial dimension substantially equal to the radial dimension of the end surface 8*b*. The wear ring 16 has a bore having a diameter adapted to the diameter of the second cylindrical portion 6*c* of the central portion 2 and an external surface which forms a connection between the surface 6*e* having a decreasing diameter of the central portion 2 beyond the shoulder 6*d* at one side and the external surface 8*d* of the coupling 8 in the form of a circular arc. The external surface of the wear ring 16 may be frustoconical or in the form of a circular arc. The external surface of the wear ring 16 may be frustoconical having conicity similar to the conicity of the frustoconical surface of the central portion 2 of the component 1. The wear ring 16 forms a relatively low-cost component in relation to the cost of the coupling 8 and the member 5 of the component. The wear ring 16 prevents direct contact between the shoulder 6*d* and the end surface 8*b* of the coupling 8. The wear ring 16 may be produced from steel whose hardness is less than that of the material forming the surface 6*e*.

The component also comprises a second wear ring 17 which is arranged in contact with the other end surface 8*c* of the coupling 8. The wear ring 17 at the other end of the coupling 8 may be identical to the wear ring 16 at the side of the shoulder 6*d*. The axial length of the wear rings 16, 17 may be between 5 and 30 mm. The second wear ring 17 comprises a radial surface in contact with the end surface 8*c* of the coupling 8 opposite the shoulder 6*d* and a second radial surface which is substantially aligned with the edge of the groove 6*b* of the central portion 2 of the component.

The component 1 comprises a coupling maintenance member which is generally designated 20. The maintenance member 20 is partially arranged in the groove 6*b*. The maintenance member 20 is axially arranged between the two edges which delimit the groove 6*b*. The maintenance member 20 projects out of the groove 6*b* in relation to the first and second cylindrical portions 6*a* and 6*c*, thereby providing a contact surface with the second wear ring 17 or, in a manner which is not illustrated, with the end surface 8*b* of the coupling 8 if the wear ring is not present. A wear surface may be provided on the maintenance member 20.

In the embodiment illustrated, the maintenance member 20 comprises at least two segments 21 and 22 which form an abutment ring for the wear ring 17 or for the coupling 8. The maintenance member 20 comprises an annular ring 23 for locking the segments 21 and 22 and at least one wedge 24 that is a lock for locking the segments 21 and 22 in relation to the member 5.

The groove 6*b* which is provided in the central portion 2 of the member 5 of the component has two substantially radial edges and a bottom of generally cylindrical shape generated by revolution. In the region of the edges, the bottom may have a slightly increased depth in order to facilitate machining. Furthermore, at least one blind concavity 25 is provided in the bottom over a limited angular sector and over an axial length which is less than the axial length of the bottom. In this instance, there are two concavities 25. The concavities 25 are regularly distributed circumferentially. In this instance, the concavities 25 are of elongate shape in the sense that their length along the axis of the component is distinctly greater than their width taken in the circumferential direction.

In this instance, there are two segments 21 and 22, each occupying an angle of 180°. The segments 21 and 22 are identical. The segments 21 and 22 have an L-shaped cross-section when viewed as an axial section. The segments 21 and 22 comprise a large axial portion 21*a*, 22*a* and a small radial portion 21*b*, 22*b* in relation to the axial portion. The axial portion 21*a*, 22*a* is received in the groove 6*b* with an external surface flush with the external surface of the cylindrical portions 6*a*, 6*c* of the central portion 2 and the ends in accordance with the edges of the groove 6*b* in terms of shape. The radial portion 21*b*, 22*b* is arranged at the side of the coupling 8. The radial portion 21*b*, 22*b* projects outwards in relation to the groove 6*b*. The radial portion 21*b*, 22*b* is in contact with the second wear ring 17 in this instance.

In the event of axial loading in the direction of disassembly, the second wear ring 17 moves into abutment against the radial portion 21*b*, 22*b* of the segments 21 and 22 and the opposite end of the segments 21 and 22 moves into abutment against the edge of the groove 6*b* located at the opposite side to the coupling 8. The segments 21 and 22 form a surface for maintaining the axial position of the coupling 8. The axial portion 21*a*, 22*a* of each segment 21, 22 has a bore in contact with the bottom of the groove 6*b*.

The axial portion 21*a*, 22*a* has a concavity 26 which is provided from the bore. The concavity 26 has dimensions similar to the blind concavity 25 of the bottom of the groove 6*b*. The two facing concavities 25 and 26 form a chamber, in which a wedge 24 is arranged. In this instance, the wedge 24 is in the form of an integral plate, generally of metal, corresponding to the concavities in terms of shape. The wedge 24 is fixed to the segments 21 and 22 by two screws 33. The wedge 24 prevents the rotation of the corresponding segment about the member 5 of the component, the segments forming an abutment ring.

The radial portion 21*b* and 22*b* of the abutment ring comprises an external surface having a diameter compatible with the diameter of the external surface of the second wear ring 17. The external surface of the radial portion 21*b* and 22*b* is of frustoconical shape in this instance.

The annular locking ring 23 is arranged around the segments 21 and 22 forming an abutment ring. The locking ring 23 is integral. The locking ring 23 has a bore 23*a* of cylindrical shape generated by revolution in contact with the external surface of the axial portion 21*a*, 22*a* of the segments 21 and 22, a substantially radial end surface 23*b* which has large dimensions and which is in contact with the radial surface of the radial portion 21*h*, 22*b* of the segment at the side opposite the second abutment ring, an end surface 23*c* which has small dimensions and which is arranged at the free side of the locking ring, and an external surface 23*d* of variable diameter. The diameter of the external surface 23*d* increases from the end surface 23*c* to the end surface 23*b*.

The segments 21 and 22 are each provided with a lock formed by the wedge 24 which is partially arranged in the concavity 25. The segments 21 and 22 are mounted on the central portion 2 of the component by a radial movement. The annular locking ring 23 is arranged around the external surface of the member 5 of the coupling 8, in this instance the first cylindrical portion 6*a*, then displaced in translation until it comes into contact with the radial portion 21*b*, 22*b*. In that position, which is illustrated in FIGS. 1 and 2, the free end surface 23*c* of the locking ring 23 is substantially aligned with the opposite edge of the groove 6*b*. However, the locking ring 23 could extend axially beyond the groove 6*b*, surrounding the first cylindrical portion 6*a* of the external surface of the central portion 2 of the component 1 over a selected length.

Figure 3:
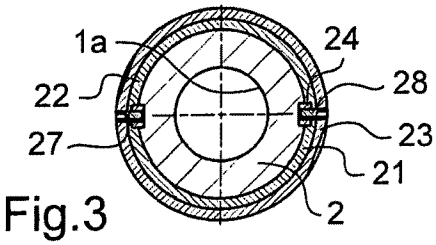
FIG. 3 is a sectioned view taken along III-III in FIG. 1.
Figure 4:
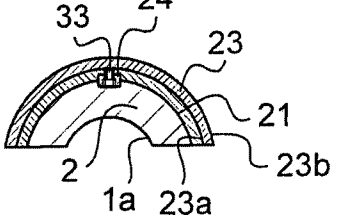
FIG. 4 is a sectioned view taken along IV-IV in FIG. 2.

For each segment 21, 22, there is provided a mainly radial orientation hole 27 which extends through the locking ring 23, the segment 21, 22 and the corresponding wedge 24. The hole 27 is threaded and provided with a screw 28 which brings about the axial and circumferential fixing of the locking ring 23 with respect to the segments 21 and 22 and the wedges 24. The screw 28, which can be seen more clearly in FIG. 3, may comprise a hollow head which is provided with a driving indentation of the recessed hexagonal type. The screw 28 may be replaced by a pin in one variant.

For robust fixing of the locking ring 23 in relation to the segments 21 and 22, it is possible to make provision for each segment 21, 22 to be provided with a stud 29 and the locking ring 23 to be provided with a groove 30 corresponding to the stud, making it necessary during assembly to rotate the locking ring 23 through a selected angle, for example, in the order of from 10 to 30°, after its axial displacement as far as the radial portion 21*b*, 22*b* of the segments 21 and 22. The studs 29 and the grooves 30 form a bayonet type assembly, see FIGS. 8 and 9. The holes of the locking ring 23 are placed in alignment with each hole of a segment 21, 22 and a corresponding wedge 24. Any axial and tangential loads applied to the locking ring 23 are taken up by the stud 29 of the segments 21 and 22. Therefore, the screw 28 substantially ensures anti-rotation locking, whereby considerably reduced loads are applied to the screw 28. In a variant, the stud 29 is replaced by a bar which is in the form of a circular arc and which occupies an angular sector in the order of from 40 to 60°, extending by means of a radial portion occupying a small angular sector in the order of from 8 to 20°.

As can be seen in FIGS. 1 and 5, a plurality of holes 31 having a small diameter are provided in the coupling 8. The holes 31 are through-holes. The holes 31 may be radial. The holes 31 are provided in a plurality of annular rows which comprise a plurality of holes which are regularly distributed circumferentially. The holes 31 are arranged outside the abutment zones. The coupling 8 may be provided with a row of holes arranged between the end surface 8*b* and an abutment zone, a row of holes arranged between the end surface 8*c* and an abutment zone and a row of holes arranged between the two abutment zones. In the embodiment illustrated, a central row of radial holes is arranged in the intermediate zone 15 having a diameter smaller than the diameter of the abutment zones. The radial holes 31 allow a flow of fluid and equilibrium of pressure between the interior and the exterior of the coupling 8. The diameter of the radial holes 31 is between 1 and 5 mm. They may have a greater diameter at the side opening at the external surface of the coupling.

The channels 9, 10 of the coupling 8 distribute the drilling fluid. The channels 9, 10 are provided radially towards the outer side from the bore 8*a*. More specifically, the coupling 8 comprises a plurality of annular channels 9, three of them in this instance, see FIG. 5. The annular channels 9 are aligned with the radial holes 31, the radial holes 31 opening in the bottom of the annular channels 9.

There are also provided a plurality of helical channels 10 which extend from one end to the other of the bore 8*a* of the coupling 8 and which open at the ends, at the radial end surfaces. The helical channels 10 may have an angle generatrix in the order of from 15° to 70° in relation to an axial plane. The profile of the annular channels 9 and helical channels 10 may be the same. The profile of the channels may comprise a bottom which extends parallel with the axis of the coupling 8 and two symmetrical edges having an angle between 30 and 50° relative to the bottom. The depth of the channels may be between 1 and 5 mm. The profile of the channels in relation to the internal wall may be gentle. The profile of the channels may utilise two different radii of curvature. The length of the bottom of the channels may be between 2 and 10 mm. The opening of the helical channels 10 at the radial end surfaces forms an inlet/outlet for the flow of drilling fluid between the coupling 8 and the second cylindrical portion 6*c* of the central portion 2.

Channels 11, 12 are arranged in the end surfaces 8*b*, 8*c* of the coupling 8. An annular channel 11 is arranged substantially half way between the edges of the radial end surface 8*b*, 8*c*, radially substantially in the region of the intermediate zone 15. This configuration allows the formation of a fluid bearing in the region of the abutment face of the coupling 8 against the member 2 in the drilling well. A plurality of helical channels 12, in this instance 24 channels, have an inclination of between 10 and 30° in relation to the tangent. The helical channels 12 are regularly distributed circumferentially. The helical channels 12 intersect with the annular channel 11. The helical channels 12 have a depth and a width smaller than the corresponding dimensions of the annular channel 11. The helical channels 12 may have a width in the order of from 2 to 3 mm and a depth in the order of from 1 to 2 mm. The helical channels 12 are, in some cases, in a state of intersection with the opening of the helical channels 10 of the bore 8*a* of the coupling 8. The annular channel 11 is radially spaced apart from the opening of the helical channels 10 of the bore 8*a* of the coupling 8. The annular channel 11 of the end surface 8*b*, 8*c* may have a width in the order of from 2 to 5 mm and a depth in the order of from 1.5 to 5 mm.

The helical channels 12 of the front surfaces of the coupling 8 form inlets/outlets 32 for the flow of drilling fluid between the front surface 8*b*, 8*c* of the coupling 8 and the wear ring 16, 17. The inlets/outlets 32 allow the supply of drilling fluid between the coupling 8 and the member 5, thereby forming a fluid bearing. The helical channels 12 which are provided at the free ends of the coupling 8 are thereby arranged between the coupling 8 and the member 5 of the component. In accordance with the direction of flow of the drilling fluid, the inlets/outlets 32 which are provided at the side of the shoulder 6*d* are upstream or downstream and the inlets/outlets 32 provided opposite the shoulder 6*d* are downstream or upstream, respectively. The annular channels 9 and helical channels 10 of the bore 8*a* and the annular channel 11 of the end surface 8*b*, 8*c* and helical channel 12 together form an opening for the flow and distribution of the drilling fluid, resulting in low friction between the coupling 8 and the member 6. According to variants, the annular channels 9 and 11 may be dispensed with.

Figure 9:
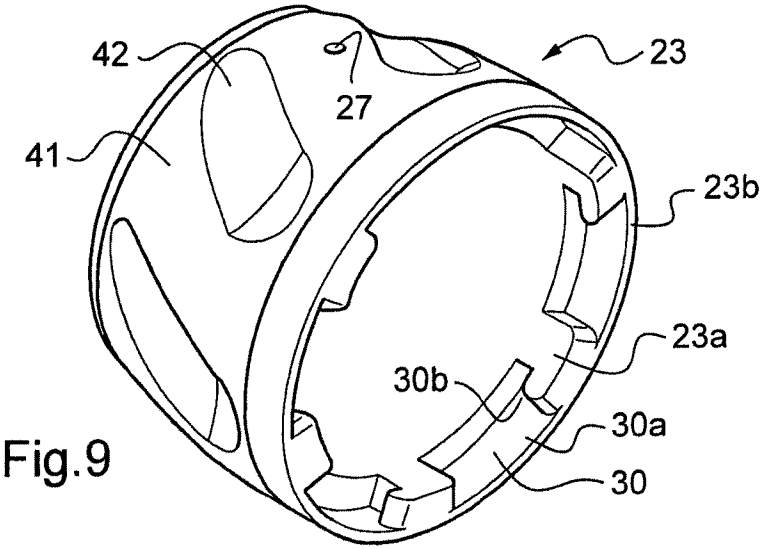
FIG. 9 is a detailed perspective view of an activation coupling which is part of the element of FIG. 7.
Figure 8:
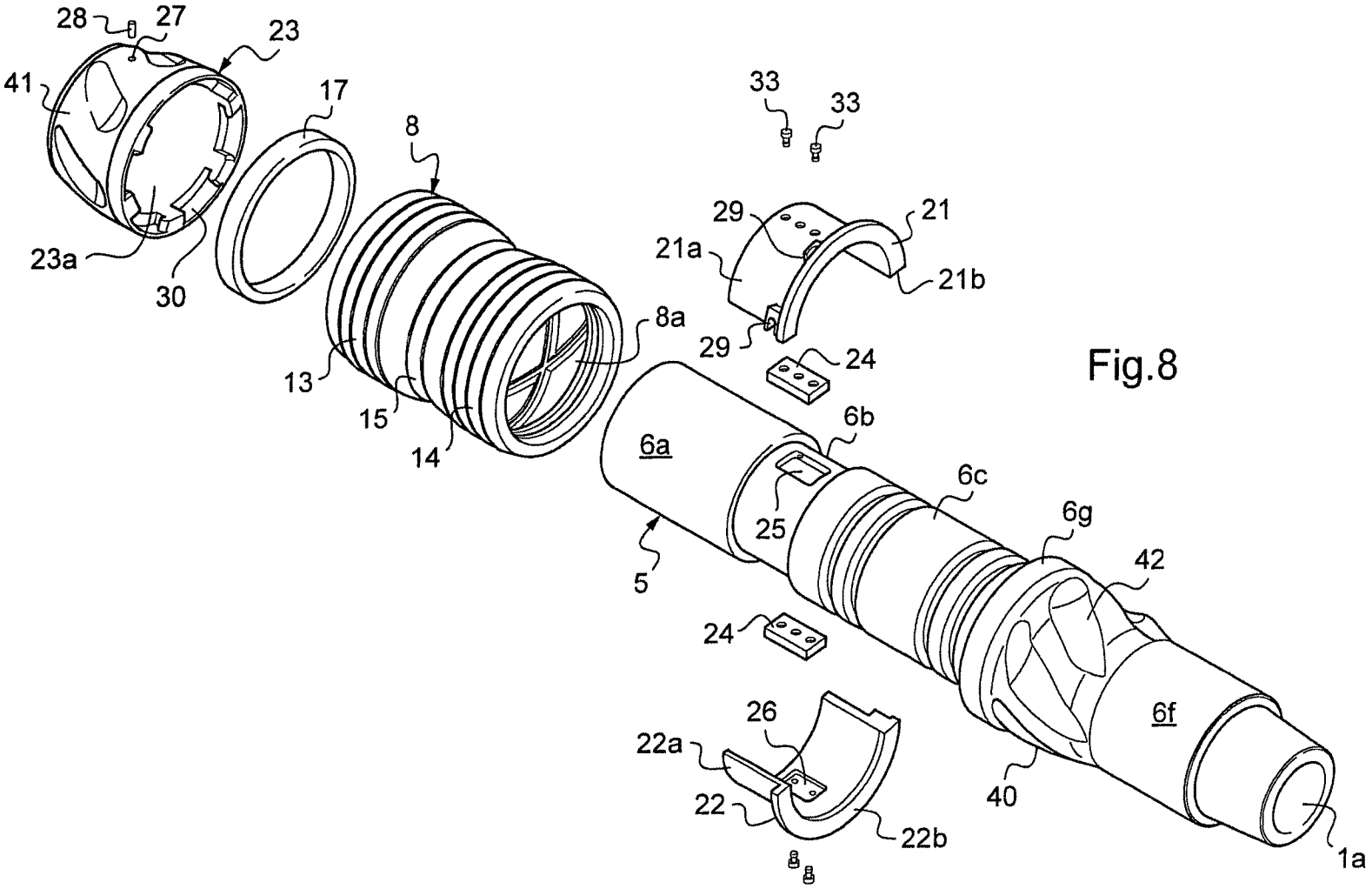
FIG. 8 is an exploded view of FIG. 7.

In the embodiment illustrated in FIGS. 7 to 9, the component 1 comprises two activation zones 40, 41 each comprising an external surface tangent to the outer cylindrical portion 6*a*, 6*f* and being connected to a cylindrical portion which has a large diameter and which forms part of the external surface 6 of the central portion 2. The activation zone 40 comprises a plurality of grooves 42 which are formed in a helical manner. The grooves 42 generally have a shape which promotes the raising of mud in the direction of the rotation of the pipe string. The grooves 42 extend axially from the outer cylindrical surface 6*a*, 6*f* as far as a location in the region of the cylindrical portion 6*g* having a large diameter of the external surface 6 of the central portion 2. The angle of inclination of the helix of the grooves 42 relative to the axis may be between 7 and 45°. For a detailed description of the activation zones, it is possible to refer to document FR 2927937. Another activation zone 41 is provided on the external surface of the locking ring 23. In the embodiment illustrated, no wear ring is provided at the side of the shoulder 6*d*. The coupling 8 comes directly into contact with the shoulder 6*d* of the central portion 2.

As can be seen more specifically in FIG. 9, the locking ring is provided with a bayonet type fixing means with locking by means of a screw 28 which is visible in FIG. 8 and which is inserted into the radial holes. The bayonet type locking mechanism comprises a plurality of grooves 30 in the form of a circular arc arranged from the bore 23*a* of the locking ring 23. The grooves 30 are open at the radial surface of the ring at the side having a large diameter, in other words at the side of the coupling 8. The grooves 30 generally have an L-shaped cross-section with an axial portion 30*a* occupying a relatively small angular sector and a circumferential portion 30*b* occupying an angular sector greater than the angular sector of the axial portion 30*a*, leaving a ramp of material of the locking ring 23 for contact with a finger or stud 29 of at least one segment 21, 22 forming an abutment ring, in this instance with a finger of each segment. In order to facilitate locking by an operator, there are provided in this instance six grooves 30 which have to co-operate with six fingers, resulting in an extremely small angular excursion in order to find the fitting position by means of axial translation before the rotation movement bringing about the locking and preventing axial movement of the locking ring in relation to the components.

The invention claimed is:

1. A drill stem element for drilling a well with flow of a drilling fluid around an element and in a direction extending from a drilling well bottom towards a surface, comprising:

a member; and a coupling mounted to rotate about the member, wherein the coupling comprises at least two abutment zones to abut against a wall of the well during drilling, each abutment zone externally including at least one abutment portion having an outer diameter greater than a diameter of other portions of the element, each abutment zone having a convex rounded shape generated by revolution, each abutment zone being axially remote from at least one other abutment zone;

the coupling further comprising an intermediate zone provided between the two abutment zones, an opening being provided between the coupling and the member for the flow of drilling fluid between the coupling and the member forming a fluid bearing, the coupling further comprising at least one drilling fluid distribution channel provided on an internal surface of the coupling, and the channel comprises at least one helical portion, or two helical portions with one orientated to the left and the other orientated to the right.

2. The drill stem element according to claim 1, wherein the opening is in fluid communication with a plurality of holes which are circumferentially distributed and which are arranged in the coupling between an external surface and the internal surface.

3. The drill stem element according to claim 2, wherein at least one hole opens in a portion of the external surface having a diameter smaller than the diameter of a abutment zones.

4. The drill stem element according to claim 1, wherein the intermediate zone of the coupling has a diameter smaller than the diameter of the abutment portions, or smaller by from 5% to 10% of a diameter of a abutment zones.

5. The drill stem element according to claim 1, wherein the coupling has an end having a diameter smaller than the diameter of the abutment portions.

6. The drill stem element according to claim 1, wherein the coupling comprises at least one annular channel, or two annular channels.

7. The drill stem element according to claim 1, wherein the member comprises at least one zone in contact with the internal surface of the coupling, a hardness of the zone being greater than a hardness of the internal surface of the coupling.

8. The drill stem element according to claim 1, wherein the abutment portion has a hardness greater than a hardness of a remainder of an external surface of the coupling.

9. The drill stem element according to claim 1, wherein the abutment portion has a cylindrical geometry, the abutment portion comprising, at one side and an other of the abutment portion, convex portions which surround the abutment portion along an axis of the coupling, the convex portions having a radius of curvature such that the convex portions form a tangent to the abutment portion.

10. The drill stem element according to claim 1, further comprising a wear ring mounted between a front surface of the coupling and a shoulder of the member and/or a wear ring mounted between the front surface of the coupling and a front surface of a retention member.

11. The drill stem element according to claim 1, further comprising an activation zone which comprises a plurality of grooves which are generally of helical shape around an axis of the element.

12. The drill stem element according to claim 11, wherein an activation zone is provided on an annular locking ring that comprises an internal surface in contact with and radially locking segments which form an abutment ring for the coupling.

13. A drill pipe comprising at least one drill stem element according to claim 1, and two threaded ends provided at one side and an other side of the element.

14. A drill stem element for drilling a well with flow of a drilling fluid around an element and in a direction extending from a drilling well bottom towards a surface, comprising:

a member;

a coupling mounted to rotate about the member, wherein the coupling comprises at least two abutment zones to abut against a wall of the well during drilling, each abutment zone externally including at least one abutment portion having an outer diameter greater than a diameter of other portions of the element, each abutment zone having a convex rounded shape generated by revolution, each abutment zone being axially remote from at least one other abutment zone; and an activation zone which comprises a plurality of grooves which are generally of helical shape around an axis of the element, the coupling further comprising an intermediate zone provided between the two abutment zones, an opening being provided between the coupling and the member for the flow of drilling fluid between the coupling and the member forming a fluid bearing, and an activation zone is provided on in an annular locking ring that comprises an internal surface in contact with and radially locking segments which form an abutment ring for the coupling.

15. The drill stem element according to claim 14, wherein the opening is in fluid communication with a plurality of holes which are circumferentially distributed and which are arranged in the coupling between an external surface and the internal surface.

16. The drill stem element according to claim 15, wherein at least one of the plurality of holes opens in a portion of the external surface having a diameter smaller than a diameter of the abutment zones.

17. The drill stem element according to claim 14, wherein the intermediate zone of the coupling has a diameter smaller than the diameter of the abutment portions, or smaller by from 5% to 10% of a diameter of the abutment zones.

18. A drill stem element for drilling a well with flow of a drilling fluid around an element and in a direction extending from a drilling well bottom towards a surface, comprising:

a member; and a coupling mounted to rotate about the member, wherein the coupling comprises at least two abutment zones to abut against a wall of the well during drilling, each abutment zone externally including at least one abutment portion having an outer diameter greater than a diameter of other portions of the element, each abutment zone having a convex rounded shape generated by revolution, each abutment zone being axially remote from at least one other abutment zone;

the coupling further comprising an intermediate zone provided between the two abutment zones, an opening being provided between the coupling and the member for the flow of drilling fluid between the coupling and the member forming a fluid bearing, and the member comprises at least one zone in contact with an internal surface of the coupling, a hardness of the zone being greater than a hardness of the internal surface of the coupling.

19. The drill stem element according to claim 18, wherein the opening is in fluid communication with a plurality of holes which are circumferentially distributed and which are arranged in the coupling between an external surface and the internal surface.

20. The drill stem element according to claim 19, wherein at least one of the plurality of holes opens in a portion of the external surface having a diameter smaller than a diameter of the abutment zones.

* * * * *